US008322494B2

(12) United States Patent
Hänninen

(10) Patent No.: US 8,322,494 B2
(45) Date of Patent: Dec. 4, 2012

(54) TEMPORARY MAIN SWITCH ARRANGEMENT FOR CONNECTING POWER SUPPLIES OF A POWER TOOL AND AN ELEVATOR

(75) Inventor: Ari Hänninen, Hyvinkää (FI)

(73) Assignee: Kone Corporation, Helsinki (FI)

( * ) Notice: Subject to any disclaimer, the term of this patent is extended or adjusted under 35 U.S.C. 154(b) by 373 days.

(21) Appl. No.: 12/678,462

(22) PCT Filed: Sep. 16, 2008

(86) PCT No.: PCT/FI2008/000103

§ 371 (c)(1),
(2), (4) Date: Mar. 16, 2010

(87) PCT Pub. No.: WO2009/037373

PCT Pub. Date: Mar. 26, 2009

(65) Prior Publication Data

US 2010/0188803 A1 Jul. 29, 2010

(30) Foreign Application Priority Data

Sep. 19, 2007 (FI) ..... 20070716

(51) Int. Cl.
*B66B 1/06* (2006.01)

(52) U.S. Cl. ..... 187/289; 187/413

(58) Field of Classification Search ..... 187/247, 187/248, 277, 289–297, 391–393, 900, 413; 307/66, 69

See application file for complete search history.

(56) References Cited

U.S. PATENT DOCUMENTS

| | | | | |
|---|---|---|---|---|
| 2,068,620 | A | 1/1937 | Spurgeon | |
| 5,389,748 | A * | 2/1995 | Burke et al. | 187/247 |
| 5,896,948 | A * | 4/1999 | Suur-Askola et al. | 187/290 |
| 6,315,081 | B1 * | 11/2001 | Yeo | 187/290 |
| 6,471,014 | B1 | 10/2002 | Daniel et al. | |
| 6,732,838 | B1 * | 5/2004 | Okada et al. | 187/290 |
| 6,827,182 | B2 * | 12/2004 | Araki | 187/290 |
| 7,246,686 | B2 * | 7/2007 | Smith et al. | 187/290 |
| 7,506,726 | B2 * | 3/2009 | Andrejak et al. | 187/290 |
| 7,681,694 | B2 * | 3/2010 | Aulanko et al. | 187/290 |
| 8,083,033 | B2 * | 12/2011 | Kallioniemi et al. | 187/290 |
| 2010/0258383 | A1 * | 10/2010 | Saarikoski et al. | 187/290 |

* cited by examiner

*Primary Examiner* — Anthony Salata

(74) *Attorney, Agent, or Firm* — Birch, Stewart, Kolasch & Birch, LLP

(57) ABSTRACT

A temporary main switch arrangement of an elevator includes a first switch in the electricity supply circuit of the power tool and a second switch in the electricity supply circuit of the elevator. The first switch may be fitted into the electricity supply circuit of the power tool and the second switch may be fitted into the electricity supply circuit of the elevator. When modernizing an elevator, the temporary main switch arrangement is fitted into the building's electrical system between the building's distribution circuit, the electricity supply circuit of the power tool and the electricity supply circuit of the elevator; the first switch disconnects the electricity supplies from the electricity supply circuit of the elevator; the second switch connects the electricity supplies to the electricity supply circuit of the power tool; and modernization of at least the electricity supply circuit of the elevator is performed.

18 Claims, 2 Drawing Sheets

Figure 1:
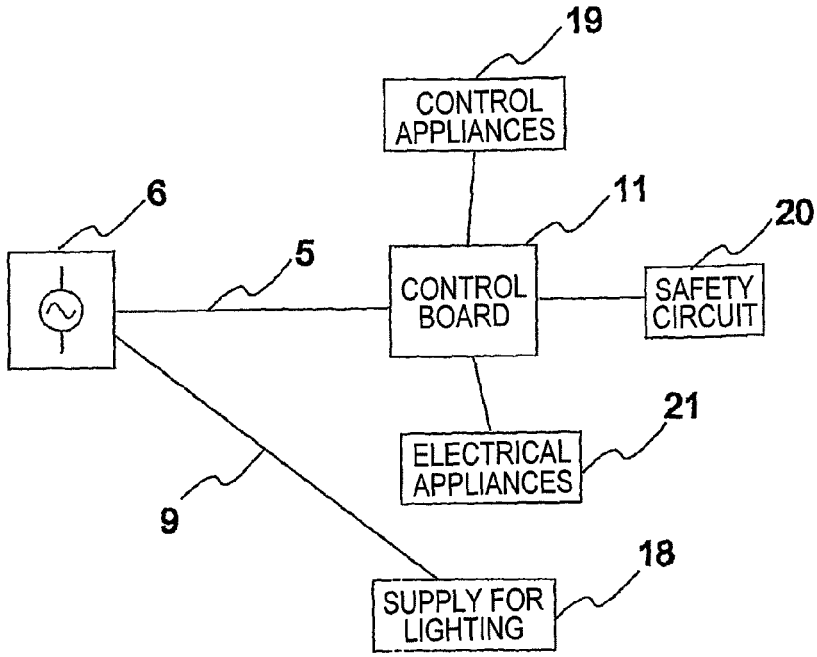
Fig. 1 PRIOR ART

TEMPORARY MAIN SWITCH ARRANGEMENT FOR CONNECTING POWER SUPPLIES OF A POWER TOOL AND AN ELEVATOR

FIELD OF THE INVENTION

The object of the invention is a temporary main switch arrangement of an elevator a method for fitting a temporary main switch arrangement into an elevator and also a method for modernizing an elevator.

PRIOR ART

When modernization work, such as disassembly, is performed on an elevator, power tools, such as a Tirak hoist, are needed. Typically the electricity supply of the hoist is connected to the supply board of the elevator. When the old control board is replaced with a new one during the course of disassembly, the old board must switched into a de-energized state. The aforementioned switching work requires a permit for electrical work, as laid down in legislation. If the person performing the disassembly work does not have such a permit, a professional is needed at the site for the set days to perform the electrical installation work.

PURPOSE OF THE INVENTION

The purpose of the invention is to disclose a temporary main switch arrangement of an elevator, which can be installed at the site in good time before commencement of the modernization work and which can be removed after the modernization work. The person performing the modernization work can during the work connect the electricity supplies of the power tool and the elevator by means of the temporary switch arrangement in the manner required by the work.

CHARACTERISTIC FEATURES OF THE INVENTION

The temporary main switch arrangement of an elevator according to the invention, the method for fitting the temporary main switch arrangement into an elevator, the method for modernizing an elevator, and other features of the invention are characterized by what is disclosed in the other claims. Some inventive embodiments are also discussed in the descriptive section of the present application. The inventive content of the application can also be defined differently than in the claims presented below. The inventive content may also consist of several separate inventions, especially if the invention is considered in the light of expressions or implicit subtasks or from the point of view of advantages or categories of advantages achieved. In this case, some of the attributes contained in the claims below may be superfluous from the point of view of separate inventive concepts.

The main switch arrangement according to the invention comprises: a switch enclosure, comprising an input for the distribution circuit of the building, a first output for the electricity supply circuit of the power tool, and a second output for the electricity supply circuit of the elevator system. The arrangement comprises a first switch in the electricity supply circuit of the power tool as well as a second switch in the electricity supply circuit of the elevator, both said switches being fitted into the switch enclosure. The temporary main switch arrangement is fitted to disconnect the electricity supply between the distribution circuit of the building, the electricity supply circuit of the power tool and the electricity supply circuit of the elevator. The aforementioned first and second switch can be, for instance, mechanical switches, either manually-operated or controllable, such as relays, contactors or line protection breakers, but they can also be controllable semiconductor switches, such as IGBT transistors or solid-state relays, i.e. switches that can be opened and closed under control. The electricity supply circuit of the power tool refers generally to the wiring and connection appliances with which the electricity supply to the power tool occurs. These kinds of wiring and connection appliances are, for instance, cables, transformers, connectors, switches or electrical power supply devices, such as inverters or inverter rectifiers, which are disposed on the power supply route of the power tool. Likewise the electricity supply circuit of the elevator refers generally to the wiring and connection appliances with which the electricity supply to the elevator system occurs. The aforementioned first and second switch are in this case disposed in the switch enclosure, and the distribution circuit of the building, the electricity supply circuit of the power tool and the electricity supply circuit of the elevator system are connected to the poles of the first and second switch in the switch enclosure. The aforementioned inputs and outputs can comprise at least the sealing of the cable entry of the cable of the electricity supply circuit, such as a rubber ring, as well as the cable clamps of the cable.

In one embodiment of the invention the first switch is fitted between the distribution circuit of the building and the electricity supply circuit of the power tool, and the second switch is fitted between the electricity supply circuit of the power tool and the electricity supply circuit of the elevator. The distribution circuit of the building refers the wiring and connection appliances with which in prior-art elevator systems the electricity supply of the building is brought e.g. from the main board of the building to the supply board of the elevator.

In one embodiment of the invention the first switch is fitted between the distribution circuit of the building and the electricity supply circuit of the power tool and the second switch is fitted between the distribution circuit of the building and the electricity supply circuit of the elevator.

One main switch arrangement according to the invention comprises a third switch in the electricity supply circuit comprising the lighting of the elevator. In this case the aforementioned third switch is fitted between the distribution circuit comprising the lighting of the elevator and the electricity supply circuit comprising the lighting of the elevator. The lighting of the elevator refers in this context to the lighting of the elevator car and possibly also of the elevator shaft. In one embodiment of the invention the aforementioned first switch is similar to the first and second switch. The distribution circuit comprising the lighting of the elevator refers to the wiring and connection appliances with which in prior-art elevator systems the electricity supply of the building is brought e.g. from the main board to at least the lighting of the elevator. The electricity supply circuit comprising the lighting of the elevator refers to the wiring and connection appliances with which the electricity supply to at least the lighting of the elevator occurs. For example, the remote monitoring system of the elevator can also be connected to the aforementioned electricity supply circuit comprising the lighting of the elevator. The remote monitoring system of the elevator can also have its own electricity supply circuit, which is brought from the electricity supply of the building directly to the remote monitoring system bypassing the supply board of the elevator. In this case one temporary main switch arrangement according to the invention can comprise a fourth switch, which is fitted into the electricity supply circuit of the remote monitoring system to disconnect the electricity supply of the remote monitoring system.

One switch enclosure according to the invention comprises inputs for the controls of the first and second switch. In this case e.g. a control handle of the first and/or of the second manually-operated switch can be fitted to the input. On the other hand, if the aforementioned switches are electrically controllable switches such as contactors, the control circuit of the electrically controllable switch, such as the coil of a contactor, can be fitted to the input.

One main switch arrangement according to the invention comprises separate terminal boxes at least in connection with the distribution circuit of the building as well as in connection with the electricity supply circuit of the elevator system. The distribution circuit of the building is in this case taken to the terminal block in the first terminal box, and a separate cable leaves the terminal block of the first terminal box to the first input of the switch enclosure. From the second output of the switch enclosure, on the other hand, a separate cable is taken to the terminal block of the second terminal box, and the electricity supply circuit of the elevator is taken from the terminal block of the second terminal box to the supply board of the elevator. When the distribution circuit of the building and the electricity supply circuit of the elevator are connected to different terminal boxes, which are in connection with the switch enclosure via separate cables, connection of the distribution circuit and the electricity supply circuit of the elevator to the temporary main switch arrangement is more flexible because the wiring does not need to reach the switch enclosure.

In one main switch arrangement according to the invention the aforementioned switch enclosure comprises a third switch in the electricity supply circuit comprising the lighting of the elevator, a second input for the distribution circuit comprising the lighting of the elevator car, and a third output for the electricity supply circuit comprising the lighting of the elevator car.

In one main switch arrangement according to the invention the aforementioned switch enclosure comprises a warning light, which is fitted to activate when the electricity supply circuit of the elevator is connected to be energized. Activation of the warning light refers to the ignition of the light in a situation when the electricity supply circuit is connected to be energized. The light is fitted to burn, either continuously and e.g. by blinking, always when the electricity supply circuit is energized. The aforementioned warning light can be, for instance, a LED light, a fluorescent tube or an incandescent bulb. Also, for example, a sound signal can be used in place of the warning light, in which case the sound warns of the energized state of the electricity supply circuit.

In one main switch arrangement according to the invention the electricity supply circuit of the elevator is taken from the first switch to the supply board of the elevator for disconnecting the electricity supply between the distribution circuit of the building and the supply board of the elevator.

One main switch arrangement according to the invention comprises separate current limiting elements to limit and/or to disconnect the flow of current. The aforementioned current limiting elements can be, for instance, fuses, fault current protectors or e.g. electronic current limiting appliances, such as current limiters implemented with active semiconductors, connected in series with at least one of the aforementioned first, second and third switches.

In one main switch arrangement according to the invention the electricity supply circuit of the elevator as well as the electricity supply circuit of the power tool comprise multicore rubber cable. In this case the temporary main switch arrangement can be quickly installed into the electrical system of the building, because the aforementioned rubber cable does not require special installation procedures or installation appliances, such as a casing pipe for the cable.

In one main switch arrangement according to the invention the distribution circuit of the building is three-phase, and likewise also the electricity supply circuit of the elevator as well as the electricity supply circuit of the power tool are three-phase electricity supply circuits. In this case the first and the second switch are three-phase switches, which are fitted to disconnect the electricity supply in all three phases. In one embodiment of the invention the distribution circuit comprising the lighting of the elevator and the electricity supply circuit comprising the lighting of the elevator are single-phase. In this case the third switch is single-phase, and it is fitted to disconnect the single-phase electricity supply.

In the method according to the invention for fitting a temporary main switch arrangement into an elevator an input for the distribution circuit of the building is made in the switch enclosure; a first output for the electricity supply circuit of the power tool is made in the switch enclosure; a second output for the electricity supply circuit of the elevator system is made in the switch enclosure; a first and a second switch are fitted into the switch enclosure; the distribution circuit of the building is taken to the switch enclosure; the first switch is fitted into the electricity supply circuit of the power tool and the second switch is fitted into the electricity supply circuit of the elevator; and a temporary main switch arrangement is fitted to disconnect the electricity supply between the distribution circuit of the building, the electricity supply circuit of the power tool and the electricity supply circuit of the elevator.

In one method according to the invention the first switch is fitted between the distribution circuit of the building and the electricity supply circuit of the power tool, and the second switch is fitted between the distribution circuit of the building and the electricity supply circuit of the elevator.

In one method according to the invention the first switch is fitted between the distribution circuit of the building and the electricity supply circuit of the power tool, and the second switch is fitted between the electricity supply circuit of the power tool and the electricity supply circuit of the elevator.

In one method according to the invention the electricity supply circuit of the elevator is taken from the second switch to the supply board of the elevator.

In the method according to the invention for modernizing an elevator the distribution circuit of the building is taken to the switch enclosure; a first switch is fitted into the electricity supply circuit of the power tool and a second switch is fitted into the electricity supply circuit of the elevator; a temporary main switch arrangement is fitted to disconnect the electricity supply between the distribution circuit of the building, the electricity supply circuit of the power tool and the electricity supply circuit of the elevator; the electricity supply between the distribution circuit of the building and the electricity supply circuit of the elevator is disconnected with the second switch; the electricity supply between the distribution circuit of the building and the electricity supply circuit of the power tool is connected with the first switch; and modernization work on at least the electricity supply circuit of the elevator is performed.

In one method according to the invention the electricity supplies are connected to the electricity supply circuit of the power tool with the first switch and to the electricity supply circuit of the elevator with the second switch; and modernization work is performed in the area that is isolated from the electricity supply circuit of the elevator.

In one method according to the invention after the electricity supply circuit of the elevator is disconnected, the old supply board is detached from the electricity supply circuit of the elevator; and a new supply board is connected to the electricity supply circuit of the elevator.

In one method according to the invention after the modernization work the electricity supplies are disconnected from the electricity supply circuit of the elevator with the second switch; the electricity supplies are disconnected from the electricity supply circuit of the power tool with the first switch; the temporary main switch arrangement is detached from the electrical system of the building; and the distribution circuit of the building is taken to the new supply board.

One power tool according to the invention is a hoisting appliance that can be fitted into the elevator shaft, such as a Tirak hoist.

ADVANTAGES OF THE INVENTION

With the invention at least one of the following advantages is achieved:

- The temporary main switch arrangement according to the invention can be installed at the site in good time before commencement of the modernization work, and the arrangement can be removed after the modernization work. The person performing the modernization work can connect the electricity supplies of the power tool and the elevator in the manner required by the modernization work by means of the temporary main switch arrangement. In this case the person performing the modernization work does not need a permit for electrical work. Installation of the main switch arrangement can be performed e.g. some weeks before the actual modernization work, in which case performing the electrical work is not a time-critical procedure with respect to the modernization work. The elevator can in this case be used normally when voltages are connected to the supply board of the elevator by means of the temporary main switch arrangement.
- After the modernization work the temporary main switch arrangement can be detached from the electrical system of the building and moved to the next location. The main switch arrangement can thus be used as a movable installation tool.
- The temporary main switch arrangement can be designed as an enclosed solution in which the switches are enclosed in the switch enclosure inside a protection against accidental touch. In this case the construction is safer than in those prior-art solutions in which the cabling of the power tool is connected in parallel directly to the terminal block of the supply board of the elevator.
- In connection with the first switch of the temporary main switch arrangement the fuses of the electricity supply circuit of the power tool can be dimensioned to be smaller than the fuses of the electricity supply circuit of the elevator. In this case the overcurrent protection of the power tool is more effective when connecting the power tool to the same electricity supply circuit as the electricity supply circuit of the elevator. The fuses of the electricity supply circuit of the elevator can in this case be fitted in connection with the temporary main switch arrangement or they can be fitted in the supply board of the elevator.
- A separate fault current protection for the electricity supply circuit of the elevator and for the electricity supply circuit of the power tool can be fitted in connection with the main switch arrangement, in which case e.g. a 300 mA fault current protection can be used in the electricity supply circuit of the power tool instead of the normal 35 mA. In this case operation of the power tool does not produce excessive trippings of the fault current protection caused by fault currents.
- If the control of the switches must be lockable, it is possible by means of the arrangement to prevent undesired switching on of the voltages of the elevator during alteration work. Locking can occur e.g. by locking the position of the handle of the manually operated switch.
- A safety device, which warns about connection of electricity supplies, can be connected in connection with the arrangement according to the invention. This kind of safety device can be, for instance, a safety light or a sound signal.
- By means of the arrangement according to the invention it is possible to switch off electricity supplies from a control board that is to be removed from the elevator. In this case the electricity supply circuit of the power tool can be connected to be energized, in which case the power tool can also be used in this work phase.
- The arrangement according to the invention can comprise also a separate third switch in the electricity supply circuit comprising the lighting of the elevator. In this case the electricity supply also of the lighting of the elevator as well as of any other devices possibly connected to this electricity supply circuit, such as the remote monitoring unit of the elevator, can if necessary be disconnected or switched on.

PRESENTATION OF DRAWINGS

FIG. 1 presents a prior-art electrical system of an elevator

Figure 2:
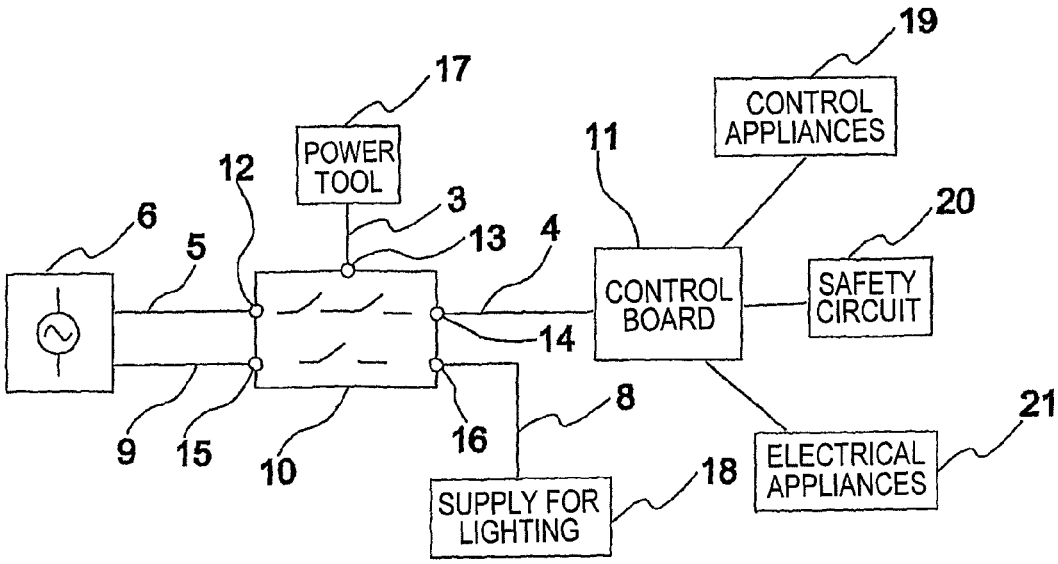
Figure 3:
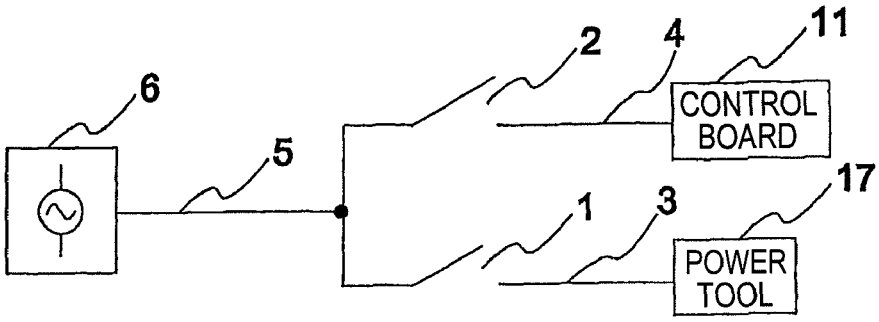
Figure 4:
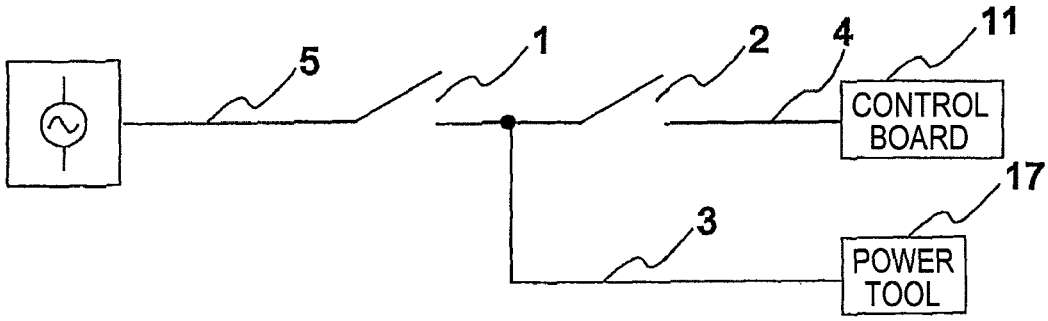

FIG. 2 presents an electrical system of an elevator, in which a temporary main switch arrangement according to the invention is fitted FIG. 3 presents a temporary main switch arrangement according to the invention FIG. 4 presents a temporary main switch arrangement according to the invention

EMBODIMENTS

FIG. 1 presents a prior-art electrical system of an elevator. The supply voltage 6 is taken with the distribution circuit 5 of the building to the supply board 11 of the elevator. This supply voltage 6 comes e.g. from the main board of the electrical system of the building. The operating voltage of the supply board 11 of the elevator is distributed to the different parts of the electrical system, such as to the control appliances 19 of the elevator, which are e.g. the elevator motor as well as the frequency converter used to control the motor, and also the operating voltage in the supply board is distributed to at least the safety circuit 20 of the elevator as well as to the other electrical appliances 21 of the elevator, such as to the elevator control electronics and to the shaft electrification. The control voltage is distributed via the safety circuit 20 of the elevator to the safety devices of the elevator, such as to the main contactors and to the control of the mechanical braking appliances. Special electrical safety regulations apply to the electricity supply of the safety circuit, relating to, among other things, restrictions on the surge currents of conductors as well as to insulation distances.

The supply board 11 of the elevator comprises a main switch for disconnecting the electricity supply of the electrical system of the elevator.

In prior art electrical systems of an elevator at least the supply 18 for the lighting of the elevator shaft and the elevator car is often brought directly from the supply voltage 6 with its own distribution circuit 9 bypassing the control board 11. The electricity supply of the power tool 17 used in the prior-art modernization work of an elevator is done e.g. by connecting the supply cables of the power tool to the control board 11.

FIG. 2 presents an electrical system of an elevator, in which a temporary main switch arrangement according to the invention is fitted. The distribution circuit of the building is detached from the control board 11 of the elevator and taken to the switch enclosure 10, in which it is connected to the first poles of the first switch 1 and the second switch 2. The supply cable in the electricity supply circuit 3 of the power tool 17 is taken to the switch enclosure 10 and connected to the second pole of the first switch 1. The supply cable, which is taken from the switch enclosure 10 to the control board 11 of the elevator, in the electricity supply circuit 4 of the elevator is connected to the second pole of the second switch 2. The electricity supply via the control board 11 of the elevator to the other parts 19, 20, 21 of the electrical system are as before. In this embodiment of the invention also the supply 9 of the lighting of the elevator is brought to the switch enclosure and connected to the first pole of the third switch (not shown in figure) in the switch enclosure. The supply cable of the electricity supply circuit 8 of the lighting is connected to the second pole of the third switch, via which the electricity supply to at least the lighting 18 occurs.

When an elevator is modernized, the old elevator is disassembled. When using the temporary main switch arrangement according to the invention, the disassembly of the elevator is performed in phases such that when disassembling parts that are not in connection with the electricity supply circuit 4 of the elevator, the voltage supply of the electricity supply circuit 4 can be connected by means of the second switch 2. When disassembling parts that are in connection with the electricity supply circuit 4 of the elevator, such as when replacing the old control board 11 of the elevator with a new one, the electricity supply circuit of the elevator is switched to be de-energized by means of the second switch 2. Although the electricity supply circuit 4 of the elevator is de-energized, it is possible by means of the first switch 1 to connect supply voltage to the electricity supply circuit of the power tool, in which case the power tool can be used in all phases of the disassembly work.

In this embodiment of the invention the power tool 17 is a Tirak hoist. When, for instance, the supply board of the elevator is replaced with a new one, the electricity supply circuit 4 of the elevator is switched to be de-energized with the second switch 2, after which the supply board 11 is removed from the electrical system of the elevator. The electricity supplies to the supply cable of the Tirak hoist 17 are connected with the first switch 1, and the old supply board of the elevator is replaced with a new one by means of the Tirak hoist.

After the disassembly work has been performed the switch enclosure 10 is detached from the electrical system of the building and the distribution circuit 5 of the building is taken directly to the new supply board 11 of the elevator. In this case the switch enclosure 10 can be moved to the next modernization location of the elevator.

FIG. 3 presents a temporary main switch arrangement according to the invention. The first poles of the first switch 1 and the second switch 2 are connected to the distribution circuit 5 of the building. The electricity supply circuit 3 of the power tool is taken first from the second pole of the first switch 1 to the power tool 17, and the electricity supply circuit 4 of the elevator is taken from the second pole of the second switch 2 to the supply board 11 of the elevator, in which case the electricity supply between the distribution circuit of the building and the power tool 17 as well as between the distribution circuit of the building and the supply board 11 of the elevator can be disconnected with the aforementioned first and second switch independently of each other.

FIG. 4 presents another temporary main switch arrangement according to the invention. The first pole of the first switch 1 is connected to the distribution circuit 5 of the building. The electricity supply circuit 3 of the power tool is connected to the second pole of the first switch, and the power tool 17 is connected to this electricity supply circuit. The first pole of the second switch 2 is connected to the electricity supply circuit 3 of the power tool, and the electricity supply circuit 4 of the elevator, which is taken to the supply board 11, is connected to the second pole of the second switch. In this case it is possible to disconnect with the first switch 1 both the electricity supply circuit 4 of the elevator and the electricity supply circuit 3 of the power tool, while with the second switch it is possible to disconnect only the electricity supply of the electricity supply circuit 4 of the elevator.

The present invention is described above by the aid of a few examples of its embodiment. It is however obvious to the person skilled in the art that the invention is not limited to the embodiments described above, but that many adaptations and different embodiments of the invention are possible within the scope of the inventive concept defined by the claims presented below.

The invention claimed is:

1. Temporary main switch arrangement of an elevator, comprising:

a switch enclosure, comprising:

an input for the distribution circuit of the building;

a first output for the electricity supply circuit of the power tool; and a second output for the electricity supply circuit of the elevator system, wherein said system, when fitted into the switch enclosure, comprises:

a first switch in the electricity supply circuit of the power tool; and a second switch in the electricity supply circuit of the elevator, and wherein the temporary main switch arrangement is fitted to disconnect the electricity supply between the distribution circuit of the building, the electricity supply circuit of the power tool and the electricity supply circuit of the elevator.

2. Main switch arrangement according to claim 1, wherein the first switch is fitted between the distribution circuit of the building and the electricity supply circuit of the power tool, and in that the second switch is fitted between the electricity supply circuit of the power tool and the electricity supply circuit of the elevator.

3. Main switch arrangement according to claim 1, wherein the first switch is fitted between the distribution circuit of the building and the electricity supply circuit of the power tool, and in that the second switch is fitted between the distribution circuit of the building and the electricity supply circuit of the elevator.

4. Main switch arrangement according to claim 1, wherein the arrangement comprises a third switch in the electricity supply circuit comprising the lighting of the elevator and in that the aforementioned third switch is fitted between the distribution circuit comprising the lighting of the elevator and the electricity supply circuit comprising the lighting of the elevator.

5. Main switch arrangement according to claim 1, wherein the aforementioned switch enclosure comprises a third switch in the electricity supply circuit comprising the lighting of the elevator, a second input for the distribution circuit comprising the lighting of the elevator and a third output for the electricity supply circuit comprising the lighting of the elevator.

6. Main switch arrangement according to claim 1, wherein the aforementioned switch enclosure comprises a warning light, which is fitted to activate when the electricity supply circuit of the elevator is connected to be energized.

7. Main switch arrangement according to claim 1, wherein the electricity supply circuit of the elevator is taken from the second switch to the supply board of the elevator to disconnect the electricity supply between the distribution circuit of the building and the supply board of the elevator.

8. Main switch arrangement according to claim 1, wherein the arrangement comprises separate current limiting elements to limit and/or to disconnect the flow of current.

9. Main switch arrangement according to claim 1, wherein the electricity supply circuit of the elevator as well as the electricity supply circuit of the power tool comprise multicore rubber cable.

10. Method for fitting a temporary main switch arrangement into an elevator, comprising:

making an input for the distribution circuit of the building in the switch enclosure;

making a first output for the electricity supply circuit of the power tool in the switch enclosure;

making a second output for the electricity supply circuit of the elevator system in the switch enclosure;

fitting first and second switches into the switch enclosure;

taking the distribution circuit of the building to the switch enclosure;

fitting the first switch into the electricity supply circuit of the power tool and the second switch into the electricity supply circuit of the elevator; and fitting a temporary main switch arrangement to disconnect the electricity supply between the distribution circuit of the building, the electricity supply circuit of the power tool, and the electricity supply circuit of the elevator.

11. Method according to claim 10, wherein:

the first switch is fitted between the distribution circuit of the building and the electricity supply circuit of the power tool, and the second switch is fitted between the electricity supply circuit of the power tool and the electricity supply circuit of the elevator.

12. Method according to claim 10, wherein:

the first switch is fitted between the distribution circuit of the building and the electricity supply circuit of the power tool, and the second switch is fitted between the distribution circuit of the building and the electricity supply circuit of the elevator.

13. Method according to claim 10, wherein the electricity supply circuit of the elevator is taken from the second switch to the supply board of the elevator.

14. Method for modernizing an elevator, comprising:

taking the distribution circuit of the building is taken to the switch enclosure;

fitting a first switch is fitted into the electricity supply circuit of the power tool and fitting a second switch into the electricity supply circuit of the elevator;

fitting a temporary main switch arrangement to disconnect the electricity supply between the distribution circuit of the building, the electricity supply circuit of the power tool and the electricity supply circuit of the elevator;

disconnecting the electricity supply between the distribution circuit of the building and the electricity supply circuit of the elevator is disconnected with the second switch; and connecting the electricity supply between the distribution circuit of the building and the electricity supply circuit of the power tool with the first switch; and performing modernization work of at least the electricity supply circuit of the elevator.

15. Method according to claim 14, wherein:

electricity supplies to the electricity supply circuit of the power tool are connected with the first switch and electricity supplies to the electricity supply circuit (4) of the elevator are connected with the second switch, and modernization work is performed in the area which is isolated from the electricity supply circuit of the elevator.

16. Method according to claim 14, wherein after disconnection of the electricity supply circuit of the elevator:

the old supply board is removed from the electricity supply circuit of the elevator a new supply board is connected to the electricity supply circuit of the elevator.

17. Method according to claim 16, wherein after the modernization work:

the electricity supplies are disconnected from the electricity supply circuit of the elevator with the second switch, the electricity supplies are disconnected from the electricity supply circuit (3) of the power tool with the first switch, the temporary main switch arrangement is removed from the electrical system of the building, and the distribution circuit of the building is taken to a new supply board.

18. Arrangement or method according to claim 1, wherein the power tool is a hoist that can be fitted into an elevator shaft.

* * * * *